United States Patent [19]

Newman

[11] 4,191,293

[45] Mar. 4, 1980

[54] BLISTER PACKAGE

[76] Inventor: Morris M. Newman, 79 Clifton Ave., Marblehead, Mass. 01945

[21] Appl. No.: 932,201

[22] Filed: Aug. 9, 1978

[51] Int. Cl.[2] ..... B65D 75/36

[52] U.S. Cl. ..... 206/467; 206/633

[58] Field of Search ..... 206/461–471, 206/633

[56] References Cited

U.S. PATENT DOCUMENTS

| | | | |
|---|---|---|---|
| 3,353,664 | 11/1967 | Armentrout et al. | 206/461 X |
| 3,476,239 | 11/1969 | Jacob | 206/461 |
| 3,507,383 | 4/1970 | Rorer | 206/471 |
| 3,599,787 | 8/1971 | Webster, Jr. | 206/469 |
| 3,721,336 | 3/1973 | Hannon | 206/633 X |
| 3,899,122 | 8/1975 | Watts, Jr. | 206/471 X |
| 3,942,640 | 3/1976 | Hellstrom | 206/461 |
| 3,967,730 | 7/1976 | Driscoll et al. | 206/461 |

FOREIGN PATENT DOCUMENTS

| | | | |
|---|---|---|---|
| 1489302 | 6/1967 | France | 206/461 |

*Primary Examiner*—Stephen Marcus

*Attorney, Agent, or Firm*—Edgar H. Kent

[57] ABSTRACT

An easy-to-open blister package having a molded blister with a receptacle and an integral flange mounted on a backing, and a spacer of lesser extent than the receptacle positioned partially under a portion of the flange and receptacle, the spacer providing a grip for separating the blister from the backing.

15 Claims, 5 Drawing Figures

FIG 1
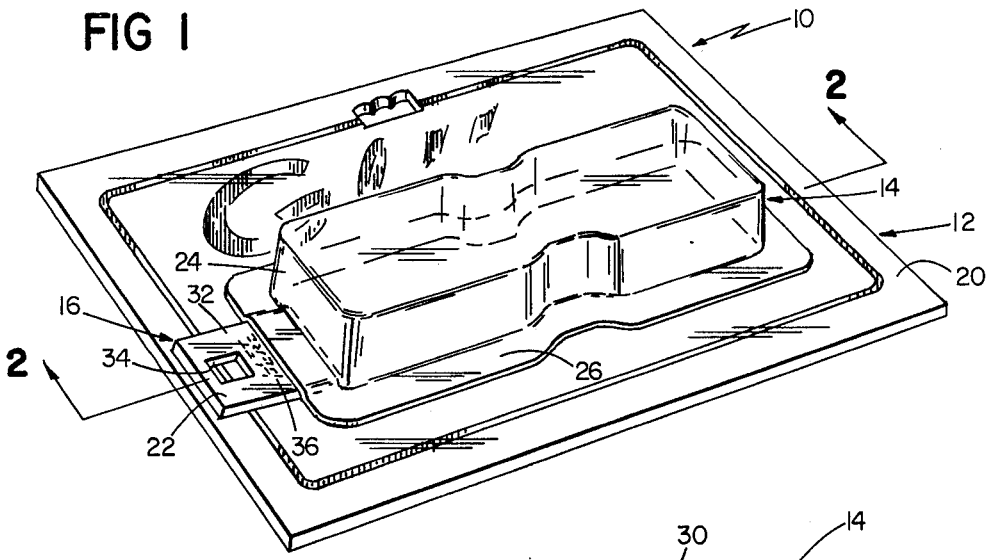
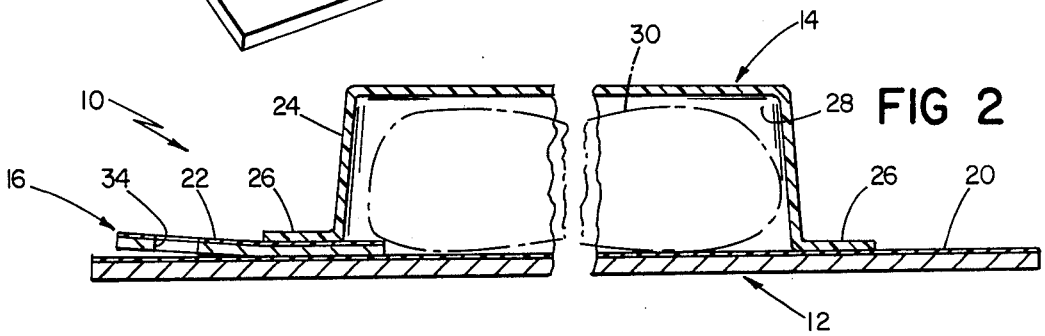
FIG 2
FIG 5
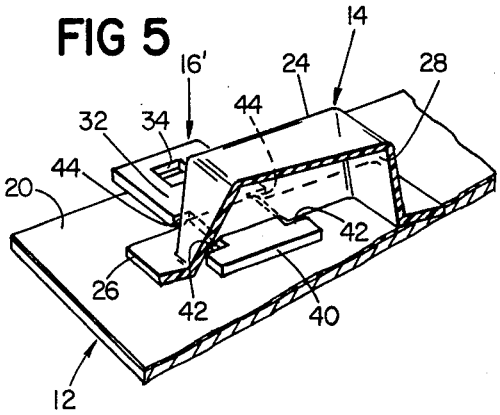
FIG 3
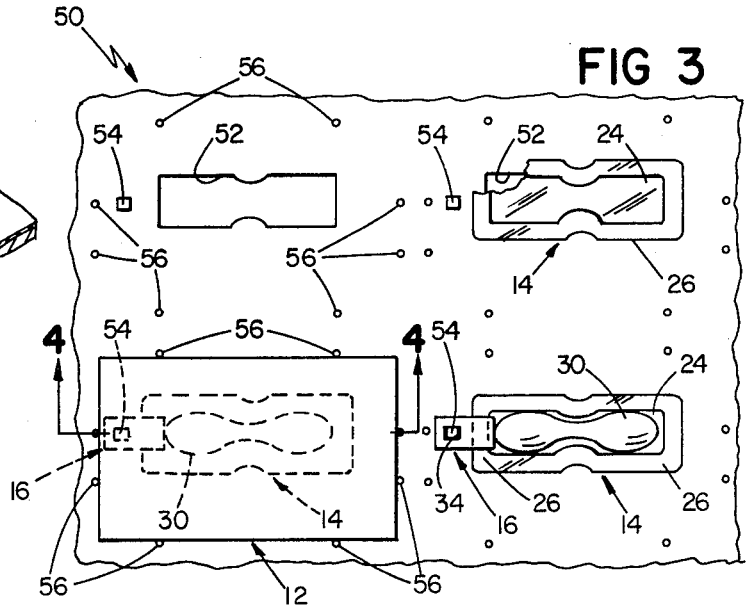
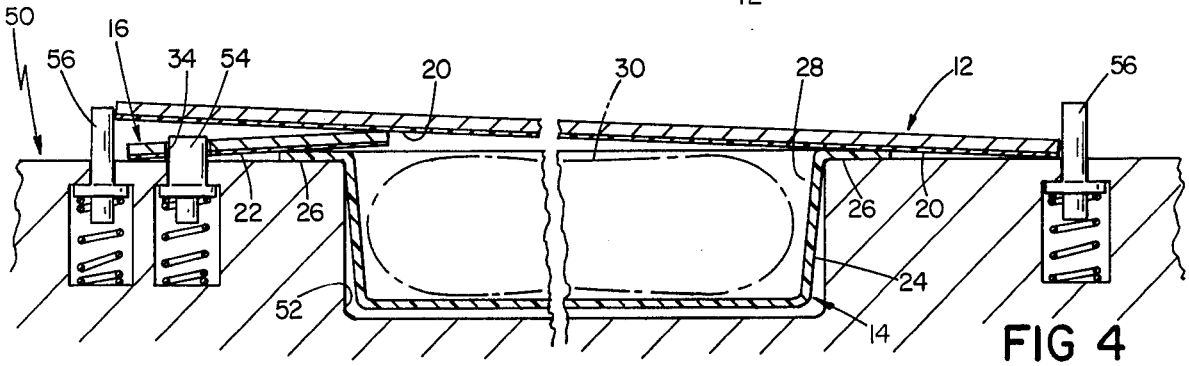
FIG 4

BLISTER PACKAGE

FIELD OF THE INVENTION

This invention relates to containers, particularly easy-to-open blister packages.

BACKGROUND OF THE INVENTION

Blister packages are used to pack a wide variety of products. Such packages usually inlcude a transparent plastic film bubble or blister secured to a stiff cardboard backing.

One common problem with blister packages is that they are often difficult to open manually, because the plastic blister and cardboard backing are not easy to tear.

There have been attempts to provide easy-to-open blister packages. For example, Hellstrom U.S. Pat. No. 3,942,640 shows a package having a blister secured about its entire periphery by an integral flange portion which is rigidly attached to a surface of a backing. The backing has an internal layer which is relatively frangible with respect to its other layers which are more resistant to tear. A pattern of score lines is cut in the backing beneath the flange of the blister. The score lines, which extend in depth between the surface of the backing and the frangible layer, promote tearing along the frangible layer when the blister is pulled away from the backing. Means are shown for grasping the blister, including a finger grip portion integrally molded in the flange of the blister.

However, Hellstrom is not readily adaptable to a user's established packaging format and existing stock of materials. Hellstrom requires backing having specific anisotropic strength characteristics. The backing must be carefully processed to provide a precisely cut pattern of score lines. New molds are required to form blisters having an integral finger grip on the flange, and these molds are very costly.

It would be desirable to provide an easy-to-open blister package which is readily adaptable to a user's current packaging stock without the need for format changes, substantial additional processing of materials, or costly mold revisions.

SUMMARY OF THE INVENTION

I have discovered that such a blister package can be obtained by providing a means for gripping the blister and not attaching to the backing a portion of a circumferential mounting flange of the blister adjacent the gripping means. Also, positioning a spacer between the backing and the circumferential mounting flange of the blister to space a portion of the flange away from the backing, provides a simple means to grip the blister and easily separate it from the backing.

In preferred embodiments the blister flange is attached around its entire circumference to the backing except for that portion of it which is spaced from the backing by the spacer; the backing is a thermoplastic coated cardboard and the blister is a thermoplastic film which is heat sealed to the coating on the cardboard; the spacer is a flat thermoplastic coated cardboard tab which is heat sealed to the flange and which has a gripping portion extending outside of the flange; the tab is anchored to the blister by shoulders which abut the flange; the tab has a noncircular positioning hole; the tab is transparent and has indicia on its gripping portion; and the blister flange is attached to the backing by frangible cement.

My blister package is simple, inexpensive, and easy-to construct. It does not require packaging format changes, and it is readily made from a wide variety of standard packaging materials without the need for substantial additional processing. The problem of costly mold revisions is eliminated. While my packaging is easy to open, the integrity of the seal is not sacrificed and can be made substantially airtight.

PREFERRED EMBODIMENT

I turn now to the structure and method of manufacture and operation of the preferred embodiment, first briefly describing the drawings thereof.

DRAWINGS

FIG. 1 is a perspective view of a blister package according to the invention.

FIG. 2 is a section, partially broken away, taken through 2—2 of FIG. 1.

FIG. 3 shows a portion of a die used in fabricating the package of FIG. 1, with the package being shown in four stages of construction.

FIG. 4 shows a section, partially broken away, through 4—4 of FIG. 3.

FIG. 5 shows a portion of an alternative embodiment tab of a blister package according to the invention.

STRUCTURE

FIG. 1 shows a container 10 having a backing 12, a blister 14, and a spacer in the form of a tab 16. Backing 12 and tab 16 are standard stiff packaging cardboard coated on their upper surfaces respectively by thermoplastic layers 20 and 22. Blister 14, made of transparent thermoplastic film, has an integrally molded receptacle 24 and circumferential mounting flange 26 surrounding the receptacle.

Referring to FIGS. 1 and 2, blister 14 is attached by flange 26 to backing 12. Tab 16 is positioned between backing 12 and flange 26 to space a circumferential portion of the flange away from the backing. Receptacle 24 projects outwardly from backing 12 to form a pocket 28 which is adapted to receive a product 30. Flange 26 is heat sealed around its periphery to layer 20 of backing 12, except for the portion of the flange spaced away from the backing by tab 16, which portion is heat sealed to layer 22 of the tab. A portion of the tab 16 extends under a receptacle wall as shown.

Tab 16, positioned transversely flange 26, has a gripping portion 32 extending outside of the flange away from receptacle 24. The tab has a square positioning hole 34 and is provided with indicia 36.

FIG. 5 shows a tab 16' having an alternative structure. Again, flange 26 is sealed around its periphery to layer 20 of backing 12, except for the portion of the flange spaced away from the backing by tab 16'. However, tab 16' has no thermoplastic coating and is not heat sealed to flange 26. Rather, anchoring portion 40 extends beyond the inner side of flange 26 and inside of pocket 28. Shoulder 42 of anchoring portion 40 abuts the inner side of flange 26 where the flange is sealed to layer 20 to prevent tab 16' from slipping outwardly from the sealed flange. Similarly, shoulder 44 in gripping portion 32 abuts the outer side of flange 26 to prevent tab 16' from slipping into pocket 28.

MANUFACTURE AND OPERATION

FIG. 3 shows a portion of a die 50 used to fabricate container 10. Four stages of construction are shown sequentially clockwise.

Starting from the upper left hand portion of FIG. 3, die 50 has a number of cavities 52. Adjacent each cavity 52 is a square positioning pin 54, and surrounding each cavity 52 are eight circular positioning pins 56.

As shown in the upper right hand portion of FIG. 3 and in FIG. 4, each cavity 52 is adapted to receive the receptacle portion 24 of a blister 14, the flange portion 26 of the blister lying on the upper surface of die 50 outside the cavity.

Referring now to the lower right hand portion of FIG. 3, a product 30 is set in receptacle 24. Then tab 16 is secured on pin 54, thermoplastic layer 22 of the tab facing flange 26 (see FIG. 4). The square pin 54 and corresponding hole 34 of the tab assure that the tab remains positioned transversely flange 26 overlying a circumferential portion of the flange.

Finally, as shown in FIG. 4 and in the lower left hand portion of FIG. 3, backing 12 is placed within pins 56 over tab 16 and flange 26, the thermoplastic layer 20 facing flange 26.

A heat press (not shown) is now applied to die 50 to thermally seal flange 26 to layer 20 of backing 12 and layer 22 of tab 16. The pins 54 and 56 are retractable (see FIG. 4) and retract into die 50 when the heat press is applied to the die, allowing backing 12 to be pressed flat against flange 26 and tab 16. After the heat press is removed, the completed container 10 is lifted from die 50.

To open container 10, the user simply grasps tab 16 by gripping portion 32 (or alternatively, inserts his finger underneath the tab, between flange 26 and backing 12) and pulls flange 26 away from backing 12 to separate the flange from layer 20 and remove blister 14.

Because the portion of flange 26 overlying tab 16 is not sealed to backing 12, the force applied to the flange through the tab causes shear stresses which readily break the bond between the flange and the backing adjacent the sides of the tab, and this break quickly propagates under the applied force around the entire periphery of the flange.

ALTERNATIVE EMBODIMENTS

Other embodiments are within the scope of the following claims. For example, tab 16 could be transparent to avoid interference with art work on the backing. Flange 16 could be sealed to backing 12 with a standard frangible packaging cement.

What is claimed is:

1. A container comprising:

a backing, a molded blister having a receptacle and an integral circumferential flange surrounding said receptacle, said receptacle facing a surface of said backing and said blister being demountably attached to said surface by said flange, said receptacle projecting outwardly from said surface of said backing to form a pocket between said blister and said backing adapted to receive a product, and a separate spacer providing a grip, said spacer being of lesser extent than the receptacle and having a first end portion and a second end portion, said first end portion extending under a small portion of a wall of said receptacle and being attached to the adjacent part of said flange, said second end portion extending away from said wall, said spacer being added without the necessity for changing said backing or said molded blister which are normally joined without said spacer.

2. The container of claim 1 wherein said flange is attached around its entire circumference to said backing except for the portion thereof which is spaced from said backing by said spacer.

3. The container of claim 2 wherein said backing is cardboard.

4. The container of claim 3 wherein said blister is a thermoplastic film and further comprising:

a thermoplastic coating on said surface of said backing, said flange being heat sealed to said coating.

5. The container of claim 2 wherein said spacer is a tab, said tab being positioned transversely said flange and having a gripping portion extending beyond the outer side of said flange away from said receptacle.

6. The container of claim 5 wherein said spacer is cardboard.

7. The container of claim 6 further comprising a thermoplastic coating on the surface of said spacer facing said flange, said spacer being heat sealed to said flange.

8. The container of claim 1 or 5 wherein said spacer is transparent.

9. The container of claim 1 or 5 wherein said spacer has indicia.

10. The container of claim 5 wherein said tab has a positioning hole in said gripping portion.

11. The container of claim 12 wherein said positioning hole is noncircular.

12. The container of claim 5 wherein said tab is transparent and has indicia on said gripping portion.

13. The container of claim 1 wherein said flange of said blister is attached to said backing by frangible cement.

14. A container comprising a backing, a molded blister having a receptacle and an integral circumferential flange surrounding said receptacle, said receptacle facing a surface of said backing and said blister being demountably attached to said surface by said flange, said receptacle projecting outwardly from said surface of said backing to form a pocket between said blister and said backing adapted to receive a product, and a tab providing a grip, said tab having an anchoring portion extending beyond the inner side of said flange inside of said pocket, said anchoring portion having a shoulder abutting the inside of said flange.

15. The container of claim 14 wherein said gripping portion has a shoulder abutting the outer side of said flange.

* * * * *

UNITED STATES PATENT AND TRADEMARK OFFICE

CERTIFICATE OF CORRECTION

PATENT NO. : 4,191,293

DATED : March 4, 1980

INVENTOR(S) : Morris Mathias Newman

It is certified that error appears in the above-identified patent and that said Letters Patent are hereby corrected as shown below:

Column 1, line 11, "inlcude" is changed to --include--.

Column 4, claim 11, "of claim 12" is changed to --of claim 10--.

Signed and Sealed this

*Tenth* Day of *June 1980*

[SEAL]

*Attest:*

SIDNEY A. DIAMOND

*Attesting Officer*

*Commissioner of Patents and Trademarks*